US009693925B2

(12) United States Patent
Schiavone

(10) Patent No.: US 9,693,925 B2
(45) Date of Patent: Jul. 4, 2017

(54) FIRST CALL POUCH AND MORTUARY COT POUCH DEVICE

(71) Applicant: Alphonso Thomas Schiavone, Gresham, OR (US)

(72) Inventor: Alphonso Thomas Schiavone, Gresham, OR (US)

( * ) Notice: Subject to any disclaimer, the term of this patent is extended or adjusted under 35 U.S.C. 154(b) by 21 days.

(21) Appl. No.: 14/638,936

(22) Filed: Mar. 4, 2015

(65) Prior Publication Data

US 2015/0290068 A1 Oct. 15, 2015

Related U.S. Application Data

(60) Provisional application No. 61/979,687, filed on Apr. 15, 2014.

(51) Int. Cl.
*A61G 17/06* (2006.01)

(52) U.S. Cl.
CPC ..... *A61G 17/06* (2013.01)

(58) Field of Classification Search
CPC .... A61G 17/06; B65D 33/06; B65D 33/2591; B65D 31/04; Y10T 29/49826; A44B 19/32
USPC ..... 27/28; 383/6, 66, 64, 109; 29/428; 24/384
See application file for complete search history.

(56) References Cited

U.S. PATENT DOCUMENTS

| | | | | |
|---|---|---|---|---|
| 4,790,051 | A * | 12/1988 | Knight | A61G 1/01 27/28 |
| 6,004,034 | A | 12/1999 | Salam | |
| 7,337,511 | B2 * | 3/2008 | Yu | A62B 31/00 27/28 |
| 7,484,275 | B2 * | 2/2009 | Carroll | A61G 17/007 27/28 |
| 8,991,019 | B1 * | 3/2015 | Calvert | A01N 1/00 27/28 |
| 2004/0252918 | A1 * | 12/2004 | Yu | A62B 31/00 383/100 |
| 2010/0263178 | A1 | 10/2010 | Jensen et al. | |
| 2013/0174392 | A1 | 7/2013 | Chua et al. | |
| 2014/0259577 | A1 * | 9/2014 | Richardson | A61G 17/06 27/28 |
| 2015/0067999 | A1 * | 3/2015 | Stefanek | A41D 27/245 27/28 |
| 2016/0101009 | A1 * | 4/2016 | Newell | A61G 17/06 27/28 |

(Continued)

*Primary Examiner* — William Miller
(74) *Attorney, Agent, or Firm* — Mohr Intellectual Property Law Solutions, PC

(57) ABSTRACT

A first call pouch includes an inner layer forming a compartment comprising at least one sidewall, a bottom wall and a top having a zippered opening. The inner layer is water resistant, proof, or sealed to contain fluids. The inner layer further including one or more pockets formed therein for storage of related items including gloves. The zippered opening is a bi-directional zipper extending substantially the entire length of the bag. An outer layer encapsulates the inner layer. The outer layer includes at least one outer sidewall, an outer bottom wall, and an outer top wall that shares the zippered opening with the inner layer whereby opening of the bi-directional zipper provides access to the inner compartment. Further, the outer bottom has a pocket adapted to receive a pad, and the outer layer top wall has at least one pocket.

15 Claims, 4 Drawing Sheets

(56) References Cited

U.S. PATENT DOCUMENTS

2016/0176622 A1* 6/2016 Vertsteylen ..... B65D 85/70
206/205

* cited by examiner

FIG. 3
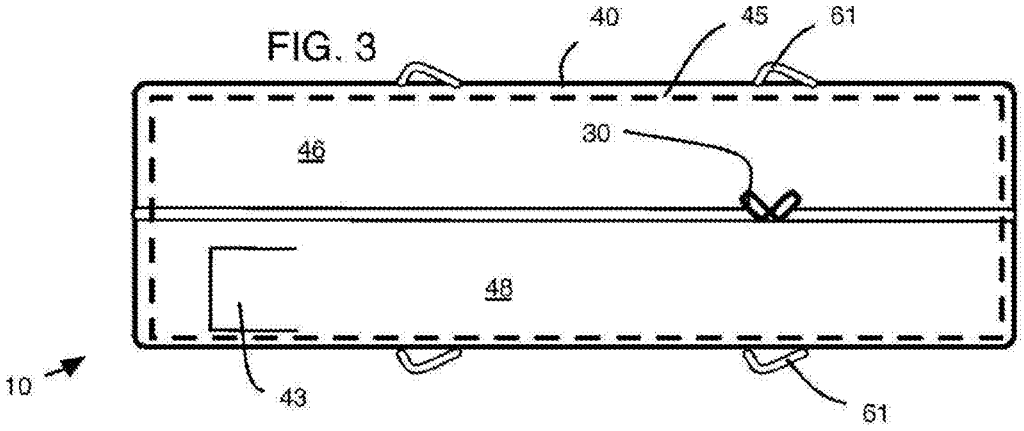
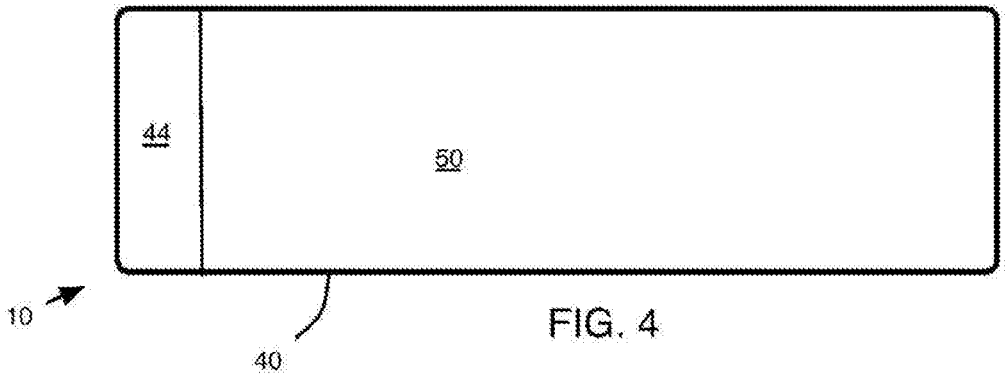
FIG. 4
FIG. 5
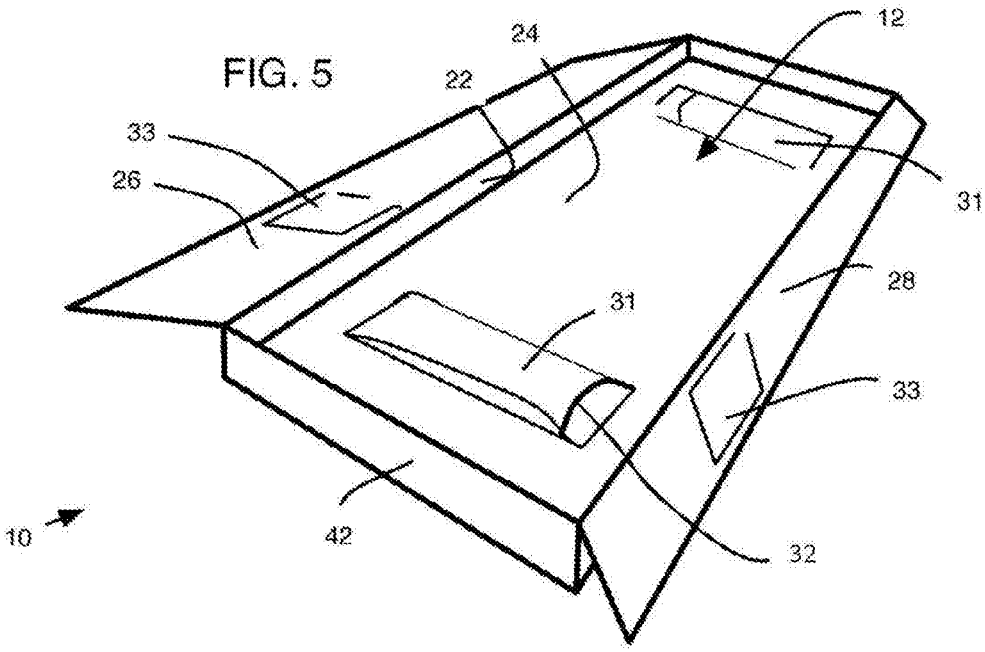

FIRST CALL POUCH AND MORTUARY COT POUCH DEVICE

PRIORITY CLAIM

The present application claims benefit under 35 USC Section 119(e) of U.S. Provisional Patent Application Ser. No. 61/979,687 filed on Apr. 15, 2014: The present application is based on and claims priority from this application, the disclosure of which is hereby expressly incorporated herein by reference

FIELD OF THE INVENTION

The present invention relates to device used to contain human remains known as a first call pouch, and more specifically to an improved first call pouch that includes improved convenience and hygienic features.

BACKGROUND

When a human dies, the decedent's body (corpse or remains) is typically encapsulated in a first call pouch for transportation. And, with the increasing emotional attachment people have with their domestic animals, there is an ever-increasing need for appropriate bag or pouch tailored to unique characteristics presented in removing animal remains from one location to another. Collectively, these bags are referred to as cadaver bags, body bags, or preferably, first call pouches.

The first call pouch functions as a means for enclosing the body, concealing it from public view, preserving the body (for forensic examination, for example), and reduce exposure or contamination of fluids caused by the body. Accordingly, a first call pouch must be both strong enough to bear the weight of human remains and remain intact even in adverse conditions but also be sufficiently lightweight so as to be readily portable.

Generally understood in the art, a common way of making a first-call bag it to cut one piece of rectangular material to size and is then folded over to make a top and bottom. Alternatively two or more rectangular pieces of material are cut, and then sewn together along one long side edge and two short ends. An opening in the top surface is made and a zipper closure is then added to the top surface of the body bag to enable a body to be inserted in and removed from the bag.

One critical aspect of a first call pouch is to encapsulate or minimize leaking bodily fluids that typically arise after death. Such fluids can contaminate the bearers or contacting surfaces. Thus, an improved first call pouch must contain such leaking fluids. Further, an improved pouch is needed that provides improved function including having one or more interior pockets or compartments to store supplies that are commonly required at a death scene. Additionally, compartments are needed to transport soiled gloves and the like without disrespecting the body.

Further, typical first call pouches include a pad on which the remains are placed. Traditionally, this pad is placed inside the bag. Two particular problems arise, however, from the pad: First, as the body is being placed in the bag, the current art pads tend to slide away from the body and bunch up in the pouch or fall out. Additionally, current pads are not protected from fluids, presenting a hygienic problem after the body is transferred from the bag.

Additional limitations of the existing art include a zipper that can only be operated in one direction. Thus, if the pouch is improperly placed, then the zipper may close head first, or feet first depending on the original placement of the bag. This causes a problem because, often, family members wish to view the face/head area of the body and do not wish to have the entire pouch sealed by the zipper.

Other known limitations in this art include damage to the bag in general and more specifically to the zippers during handling, during which the bag is subjected to accidental abuse, damage, or mistreatment, particularly during moving or transporting the body bag with a body therein. Because there is a high risk of infection to handlers and other people should body fluids escape from a body bag during transport, storage, or other handling, there still remains a need to protect the vulnerable portions of body bags from accidental damage.

One representative example of the current known art includes a body bag and method of making the same disclosed by Salam in U.S. Pat. No. 6,004,034 issued on 1999 Dec. 21. Therein Salam teaches a body bag comprising a single piece of material that is folded along fold lines and secured together along abutting short ends and mating portions to form a stronger body bag. The bag includes a zipper closure. The closure and fold lines are designed to minimize the number of secured together edges to make the bag more robust.

Another example of the current art is a disposable, lightweight, and absorbent body bag by Jensen et al disclosed in Published U.S. Pat. App. No. 2010/0263178 on 2010 Oct. 21. Therein Jensen teaches a body bag having a backing substrate, an absorbent layer, and a cover with a flap.

Yet another representative example of the current state of the art includes a body bag described in Published U.S. Pat. App. No. 2013/0174392 to Chua et al. on 2011 Jul. 11, the entire disclosure of which is hereby incorporated by reference as if fully set-out herein. Chua et al. describe a body bag having outer layers and a folded, absorbent layer. The outer layers can be made from traditional materials, such as vinyl or PVC or a non-woven layer. Chue further describes a unique folded peripheral design allowing layers to be sewn together. The use of a non-Woven material helps to prevent tearing and slows bacterial decay.

Despite attempts in the art to improve upon first call pouches, there remains yet a need for an improved first call pouch that includes multiple storage pockets, an improved, bi-directional zipper mechanism, and a pad that does not slide and that is protected from fluids. Further, such an improved pouch should incorporate the best teachings in the art in construction, lightness, water-resistance or proofing, and the like.

DRAWING

FIG. 3 is a top view of the pouch of FIG. 1.

FIG. 4 is a bottom view of the pouch of FIG. 1.

FIG. 5 is an offset top view of the pouch of FIG. 1 in a fully open position.

DESCRIPTION OF THE INVENTION

Figure 1:
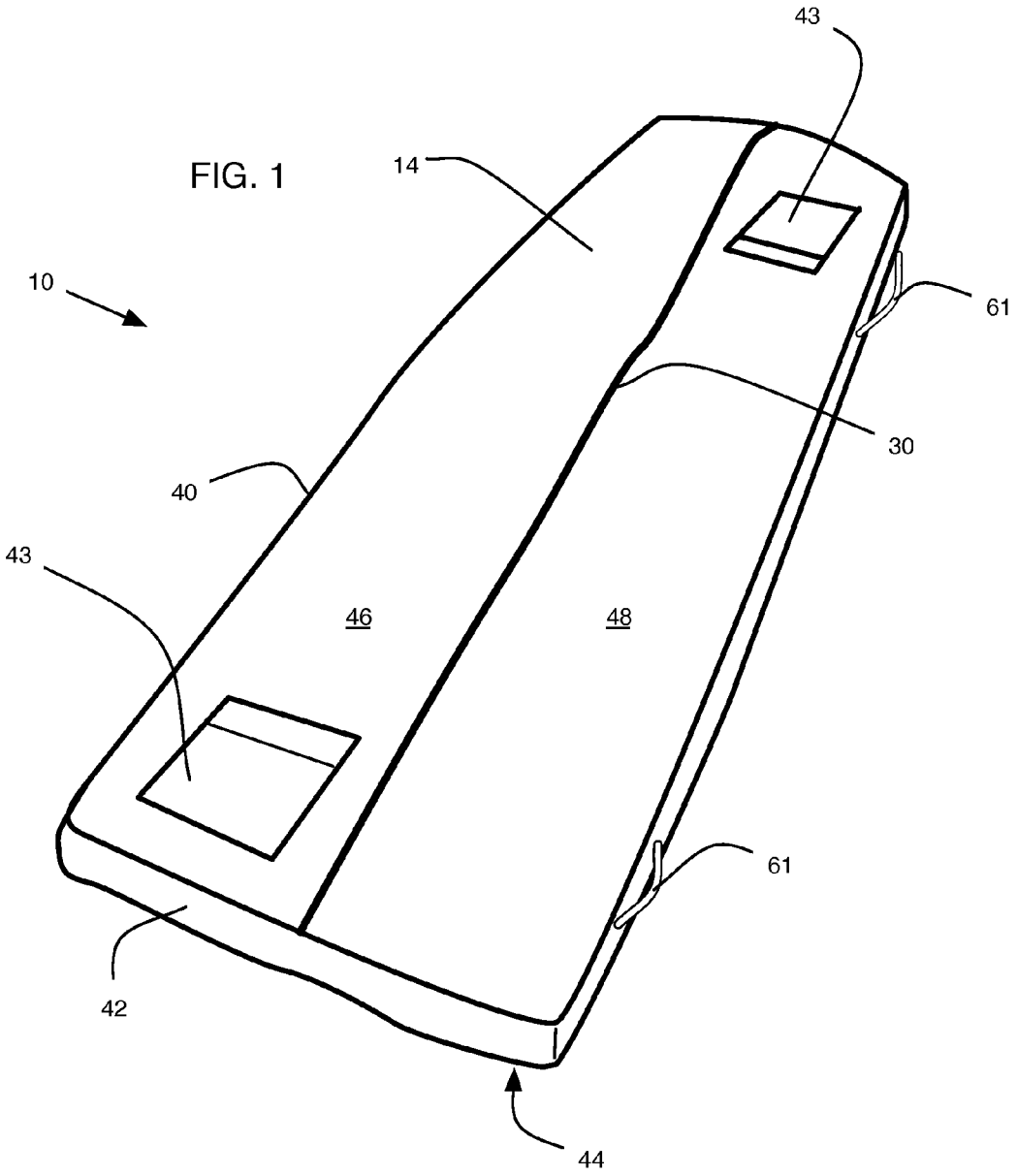
FIG. 1 is an offset top view of a first call pouch in a closed position according to one preferred embodiment of the present invention.
Figure 2:
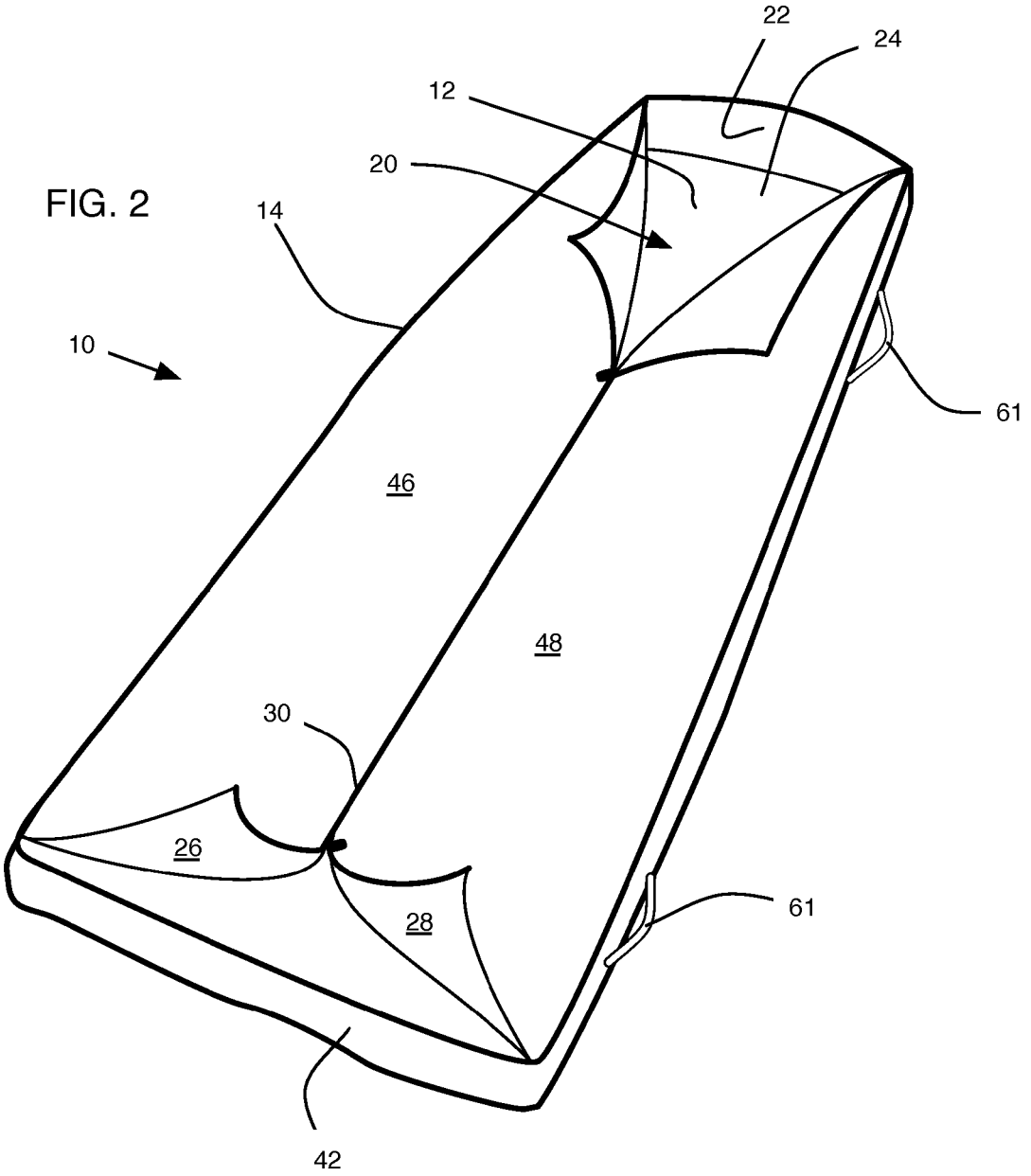
FIG. 2 is an offset top view of the pouch of FIG. 1 in a partially open position.

Possible embodiments will now be described with reference to the drawings and those skilled in the art will understand that alternative configurations and combinations of components may be substituted without subtracting from the invention. Also, in some figures certain components are omitted to more clearly illustrate the invention.

FIGS. 1 through 6 illustrate one preferred embodiment of a first call pouch or body pouch (first call pouch) 10 according to the present invention. This first call pouch 10 comprises a constructed bag comprising a pad and at least two bags. The at least two bags comprise, a (first) inner bag and a (second) outer bag whereby the inner bag is configured to nest inside the outer bag. The inner bag comprises a closeable compartment comprising at least one sidewall, a bottom wall, and a top having a zippered opening. The outer bag comprises at least one outer sidewall, an outer bottom wall, and a outer top wall, the outer top wall further comprising a bi-directional zipper aligned in parallel with the zippered opening of the inner bag whereby opening of the bi-directional zipper provides access to the (inner bag) closeable compartment. And, the outer bag further comprises a pad-pocket configured to receive the pad, the pad-pocket is disposed on an exterior portion of the outer bag bottom wall.

This first call pouch 10 includes an interior portion 12 and an exterior portion 14. The interior portion includes an inner bag 20 forming a compartment configured to receive the remains of a human or domestic animal. The inner compartment includes at least one sidewall 22, a bottom wall 24 and a top consisting of a first top half 26 and a second top half 28 with an intermediate a zippered opening with a closure means consisting of a zipper 30, such as a bidirectional zipper as shown in the drawings.

The inner bag (also referred to herein as the inner layer) 20 further includes one or more pockets formed therein for storage of related items including gloves, for example. For example, a pillow pocket 31 may serve a dual purpose for storing plastic sheets, gloves, or other supplies and also work to hold a pillow. The pillow pocket 31 includes a closable fastener device, such as a zipper 32. Other pockets, such as door pockets 33 can be included to hold other materials, supplies, and also be used to hold soiled gloves, for example.

The outer portion 14 consists of an outer layer (also referred to as an outer bag) 40 encapsulating the inner layer 20. The outer layer has at least one outer sidewall 42, an outer bottom wall 44, and a outer top wall consisting of an outer topwall first half 46 and an outer topwall second half 48, these share the zippered opening with the inner layer whereby opening of the bi-directional zipper 30 provides access to the inner compartment. The outer layer includes one or more pockets 43, see for example, FIG. 3.

Figure 6:
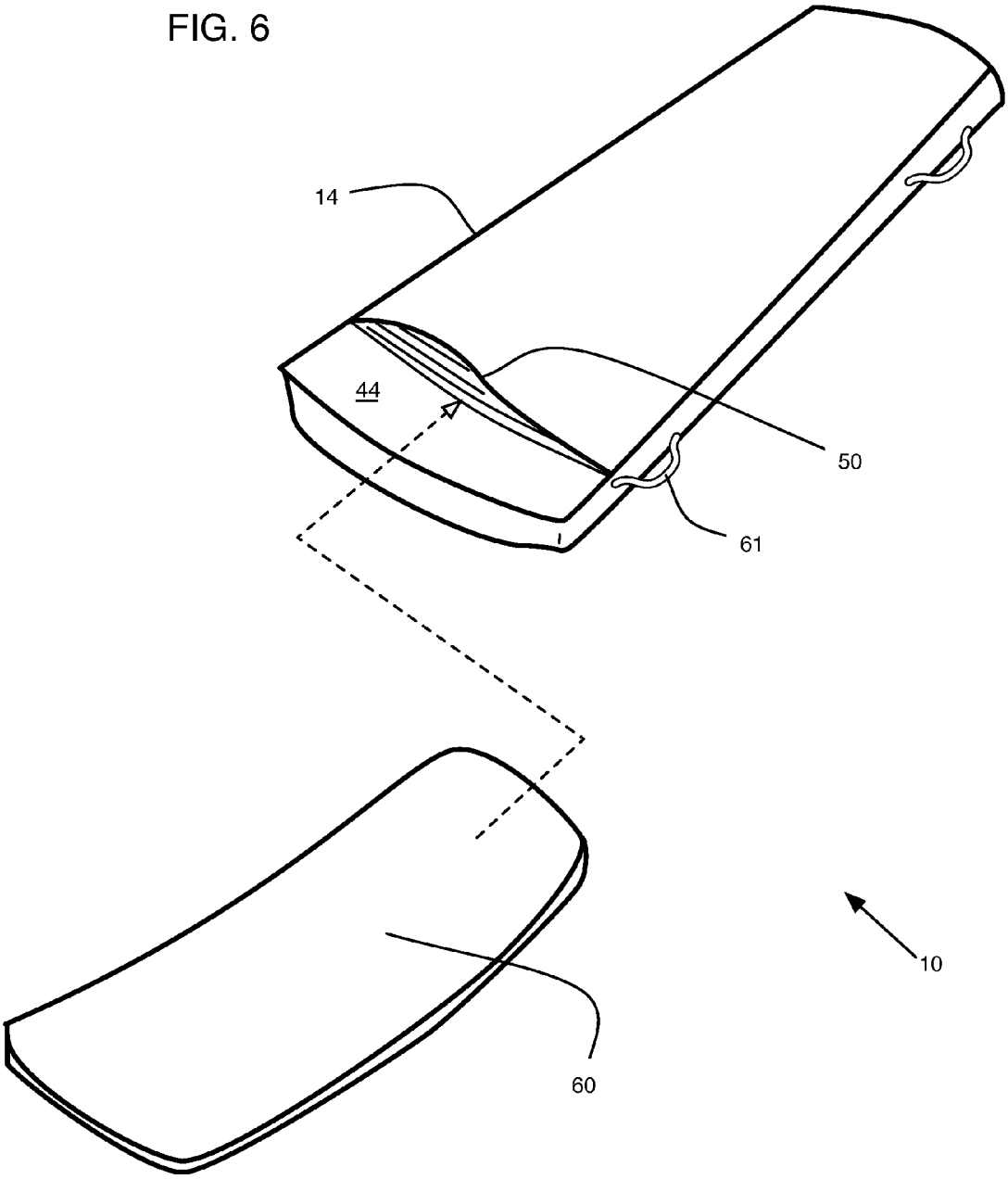
FIG. 6 is an offset bottom view of the pouch of FIG. 1 showing the relationship of a pad relative to a bottom, exterior pocket of the bag.

With specific reference to FIG. 4, the outer bottom wall 44 includes a pocket 50 adapted to receive a pad 60 (see FIG. 6, for example).

In one contemplated and preferred embodiment, the outer layer has an overall length of about 77-inches by about 16-inches high by about 20 to 23-inches wide. The height includes a fold so that the outer layer can be folded relatively flat. The exterior pockets measure substantially about 8½-inches wide by about 13½-inches long One important feature of the pouch of the present invention is symmetry from end to end. This enables a body to be oriented in either direction without loss of function. In part, the bidirectional zipper enables a body to positioned in either a N-S orientation or a S-N orientation and the head of the body will always be oriented such that the zipper can expose only the head. Another element of the invention that facilitates this is the arrangement of interior straps, interior pockets, and exterior pockets, and the pillow pockets, all of which are arranged symmetrically with respect to each end of the first call pouch so that orientation of the first call pouch.

The bidirectional zipper is preferably a water-resistant or sealed with a water-resistant sealer to reduce leakage of blood or other bodily fluids and may further have overlapping flaps of fabric to further enhance its water resistance.

The cover (outer layer, outer bag) can be any number of materials, alone or in combination, blended, woven, or otherwise. Some materials are better suited to the demands of a first call pouch and include nylon, polymers such as polypropylene or polyethylene, plastic, polyester, canvas, hemp, flax, cotton, or combinations or blends of any of the aforementioned. Preferred embodiments of the present invention contemplate an outer cover consisting of any textiles of nylon and nylon blends. Other preferred embodiments contemplate an outer cover of cotton blends, designing fabrics, upholstery, Danmask, wool, Jacquard, etc., for example.

The inner lining (inner layer or inner bag 20) material can also be any number of materials. Ideally, a more tightly woven material or water-impervious material or coating would be applied to the liner to prevent moisture penetration and includes seamless features. The cover and lining are mechanically fastened together by a thread (sewn) or by fabric welding (thermal bonding, RF bonding, and ultrasonic bonding, for example) with an adhesive member disposed between the cover material and the lining material, or a combination of sewing and fabric welding would be preferably used. A crease 45, pleat, or other fold is incorporated around the perimeter of the outer layer to enable the bag to be easily folded into shape, see FIG. 3, for example.

Located around the perimeter of the outer layer, a series of handle elements 61 arrange so that an external strap, such as a seatbelt, can be inserted there through to secure the outer layer to a vehicle or to allow for a strap to secure the outer layer to a stretcher or gurney, or other strapping members, for example. Ideally four handle elements arrange, two on each long side of the outer layer, although more handles can be provided, including handles on the short (width) edges of the outer layer. The handles can be sewn on and fabricated from a strap-type material, or can be made from the same, or similar, material used with the outer layer.

In particular, the lining material, in contemplated and preferred embodiments of the present invention includes a material such as nylon, cloth, canvas, hemp, flax, cotton, polyethylene, polypropylene, polymer films, composites or combinations of these. The lining material should be partially or completely impermeable to fluids such as water, blood, body fluids, or chemicals associated with embalming or preserving a decedent's body, and further serves as a fluid barrier to prevent fluids exuded by the body from contaminating the first call pouch handlers or any surfaces that contact the first call pouch. The lining material may be a naturally fluid-impermeable material or otherwise coated, such as chemically treating the material to reduce liquid permeability.

Further, the cover (outer layer) and interior lining (inner layer), alone, or working in conjunction with each other will reduce the propensity of external fluids (such as rain, snow, ground water, etc.) from seeping into the first call pouch and thus compromising the integrity of the pouch or contaminating the body therein. Both the cover material and the lining material should be a type of material that is unlikely to tear and resist punctures from handling and should provide some level of ruggedness. The exterior cover may also include friction-enhancing properties, that is be made of a material that is a low slip or non-slip surface to enhance stability of the pouch when placed on another surface such as a stretcher, gurney or the like.

The pouch may also include one or more layers (pad), preferably at least one removable layer, that serves as a hygienic layer. The hygienic layer contains one or more active agents to reduce contamination by microbial pathogens, to reduce odors, and/or to reduce the speed of decomposition. Of course, the hygienic layer may actually comprise a multilayer material with absorbent and hygienic plies arranged in overlapping layers.

The hygienic layer (pad) may include any combination of active agents including a bactericide, fungicide, virucide, disinfectant, sanitizer, sterilizer, mildewstat, surfactant, deodorizer, absorbent, and any combination of these. Known active agents include, but are not limited to metals, metal compounds, quaternary ammonium compound, organic acid, inorganic acid, salt, sulfite, biopolymer, synthetic polymer, chitin, chitosan, enzyme, charcoal, antioxidant, or any combination of these.

The pouch may further include an insulating layer consisting of an insulating material such as nylon/fleece combinations, Gore-Tex®, Thermo-Lite®, or the like.

The pad consists of at least one layer wherein a layer consists of at least one ply and any at least one ply can consist of a hygienic layer, an absorbent layer, an active layer, an insulating layer, or a cushioning layer, or any combination of these.

Some fastening straps are sewn or otherwise coupled so to be available inside the pouch to position the body and secure it relative to the inner portion of the bag. Other straps may be accessible to the exterior of the pouch so it can be secured to a stretcher or gurney, for example.

The pouch may further include one or more integrated handles to facilitate carrying the pouch easier when a body is confined therein.

Although the invention has been particularly shown and described with reference to certain embodiments, it will be understood by those skilled in the art that various changes in form and detail may be made without departing from the spirit and scope of the invention.

I claim:

1. A first call pouch for a deceased body comprising:

a constructed bag comprising a pad and at least two bags;

the at least two bags comprise, a inner bag and a outer bag whereby the inner bag nests inside the outer bag; further the inner bag comprises a closeable compartment for receiving the body comprising at least one sidewall, a bottom wall, and a top having a opening;

a outer bag comprises at least one outer sidewall, an outer bottom wall, and a outer top wall, the outer top wall further comprising a bi-directional zipper aligned in parallel with the opening of the inner bag whereby opening of the bi-directional zipper provides access to the closeable compartment of the inner bag; and the outer bag further comprises a pad-pocket receiving the pad therein, the pad-pocket is disposed on an exterior portion of the outer bag bottom wall.

2. The first call pouch of claim 1 further comprising:

at least one pocket arranged on an exterior face of the outer top wall of the outer bag.

3. The first call pouch of claim 1 further comprising:

the inner bag further comprises a sealable material that is waterproof to contain fluids.

4. The first call pouch of claim 1 further comprising:

one or more inner pockets disposed on an exterior portion of the inner bag top.

5. The first call pouch of claim 1 wherein:

the pad comprises at least one ply wherein the at least one ply comprises any combination of a hygienic layer, an absorbent layer, an active laver, an insulating layer, or a cushioning layer.

6. The first call pouch of claim 5, wherein the hygenic layer comprises:

any combination of the following active agents including a bactericide, fungicide, virucide, disinfectant, sanitizer, sterilizer, mildewstat, surfactant, deodorizer, absorbent.

7. The first call pouch of claim 5, wherein the active layer comprises:

any combination of the following active agents metals, metal compounds, quaternary ammonium compound, organic acid, inorganic acid, salt, sulfite, biopolvmer, synthetic polymer, chitin, chitosan, enzyme, charcoal, and antioxidant.

8. The first call pouch of claim 1 further comprising:

one or more integrated handles disposed on an exterior portion of the outer bag.

9. The first call pouch of claim 1 wherein:

the outer sidewall further comprises at pleat or fold disposed around a perimeter to enable the first call pouch to fold flat.

10. A method for assembling a first call pouch for a deceased body, the method comprising:

providing an inner bag, the inner bag comprising a closeable compartment for receiving the body comprising at least one sidewall, a bottom wall, and a top having a zippered opening;

providing a pad;

providing an outer hag, the outer bag comprising at least one outer side all, an outer bottom wall, and a outer top wall, the outer top wall further comprising a bi-directional zipper aligned in parallel with the zippered opening of the inner bag whereby opening of the bi-directional zipper provides access to the closeable compartment of the inner bag, and the outer bag further comprises a pad-pocket configured to receive the pad, the pad-pocket is disposed on an exterior face of the outer bottom wall;

inserting the pad into the pad-pocket;

and inserting the inner bag into the outer bag.

11. The method claim 10 further comprising:

providing at least one pocket arranged on an exterior face of the outer top wall of the outer bag.

12. The method of claim 10 further comprising:

providing the inner bag with a sealable material that is waterproof to contain fluids.

13. The method of claim 10 further comprising:

providing one or more inner pockets disposed on an exterior portion of the inner bag top.

14. The method of claim 10 further comprising:

providing the inner bag with an inner bag bi-directional zipper.

15. The method of claim 10 further comprising:

providing the pad with at least one ply wherein the at least one ply comprises any combination of a hygienic layer, an absorbent layer, an active layer, an insulating layer, or a cushioning layer.

* * * * *